US009512669B2

(12) United States Patent
Šentjurc

(10) Patent No.: US 9,512,669 B2
(45) Date of Patent: Dec. 6, 2016

(54) LIFTING DOOR ASSEMBLY AND DOOR LINTEL SEALING DEVICE THEREFOR

(71) Applicant: EFAFLEX INŽENIRING D.O.O. LJUBLJANA, Ljubljana (SI)

(72) Inventor: Matjaž Šentjurc, Velenje (SI)

(73) Assignee: EFAFLEX INŽENIRING d.o.o. Ljubljana, Ljubljana (SI)

( * ) Notice: Subject to any disclaimer, the term of this patent is extended or adjusted under 35 U.S.C. 154(b) by 0 days.

(21) Appl. No.: 14/399,348

(22) PCT Filed: Apr. 24, 2013

(86) PCT No.: PCT/EP2013/058544
§ 371 (c)(1),
(2) Date: Nov. 6, 2014

(87) PCT Pub. No.: WO2013/167379
PCT Pub. Date: Nov. 14, 2013

(65) Prior Publication Data

US 2015/0096696 A1 Apr. 9, 2015

(30) Foreign Application Priority Data

May 8, 2012 (DE) ..... 10 2012 104 039

(51) Int. Cl.
*E06B 9/17* (2006.01)
*E06B 9/13* (2006.01)
*E06B 9/58* (2006.01)

(52) U.S. Cl.
CPC ..... *E06B 9/17076* (2013.01); *E06B 9/13* (2013.01); *E06B 9/58* (2013.01); *E06B 2009/588* (2013.01)

(58) Field of Classification Search
CPC ..... E06B 2009/588; E06B 9/13; E06B 9/58; E06B 2009/17084; E06B 9/17076; E06B 9/17007; E06B 5/164; E06B 7/205; E06B 2007/202
(Continued)

(56) References Cited

U.S. PATENT DOCUMENTS 1,996,108 A * 4/1935 Herr ..... E06B 9/66 160/122
4,357,978 A * 11/1982 Keller et al. ..... 160/41
(Continued)

FOREIGN PATENT DOCUMENTS

DE 3603417 A1 2/1987
DE 3921036 A1 2/1991
(Continued)

OTHER PUBLICATIONS

International Search Report mailed on Jul. 1, 2013, in connection with International Patent Application No. PCT/EP2013/058544, 5 pgs.
(Continued)

*Primary Examiner* — Katherine Mitchell
*Assistant Examiner* — Abe Massad
(74) *Attorney, Agent, or Firm* — Chiesa Shahinian & Giantomasi PC

(57) ABSTRACT

The present invention relates to a lifting door assembly (1A), in particular a clean room door assembly, comprising a lifting door (2) which has a door leaf (3), an end plate (4), and a door leaf accommodating device (5). The lifting door assembly (1A) also contains a door lintel sealing device (20A) which is provided in the area of a door lintel in such a way that the door lintel sealing device produces a sealing effect between the lifting door (2) and the door lintel. At least one part (10B) of the door lintel sealing device (20A) is
(Continued)

Figure 1B:
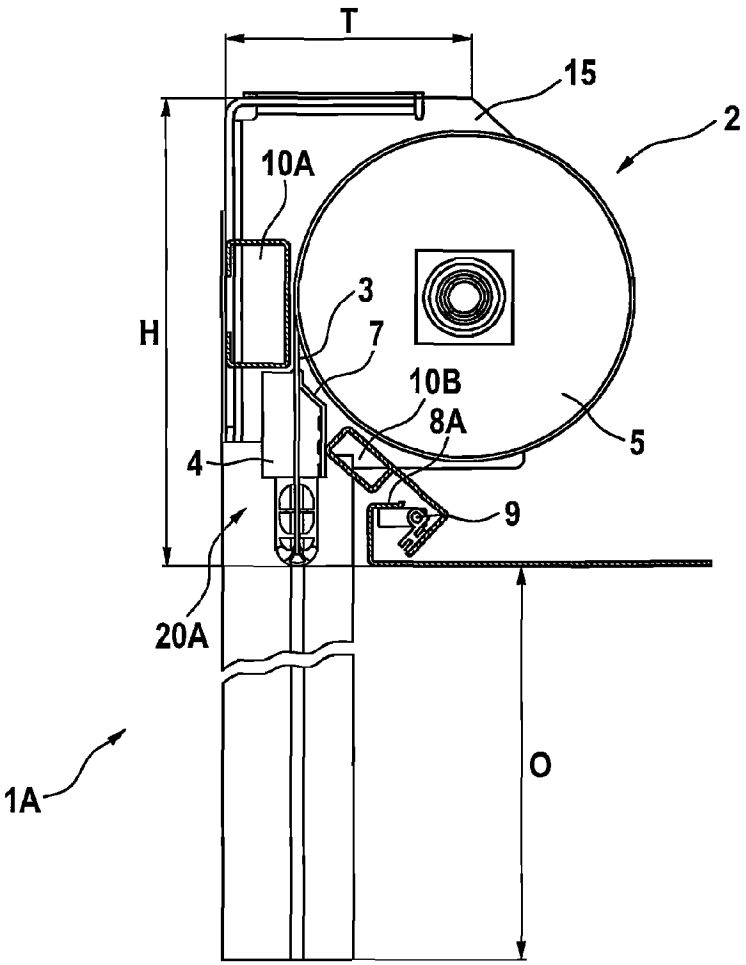

pivotably retained by means of a hinge and, when the lifting door (2) is opened, can be pivoted from a door leaf plane by an actuating device in the area of the end plate (4) in such a way that the end plate (4) is arranged substantially completely outside the area of a door opening (O) in the opened state of the lifting door (2). By means of the invention, a lifting door assembly (1A) can be improved in such a way that the entire passage height of the door opening (O) can be used with the lifting door assembly and furthermore an adequate sealing effect is achieved when the lifting door (2) is closed.

18 Claims, 5 Drawing Sheets

(58) Field of Classification Search
USPC ..... 49/480.1
See application file for complete search history.

(56) References Cited

U.S. PATENT DOCUMENTS

| | | | | |
|---|---|---|---|---|
| 4,506,720 | A * | 3/1985 | Iwanicki | 160/26 |
| 5,445,209 | A | 8/1995 | Lichy | |
| 5,482,104 | A * | 1/1996 | Lichy | 160/273.1 |
| 5,732,419 | A * | 3/1998 | Feist | 4/558 |
| 6,152,208 | A * | 11/2000 | Kalempa et al. | 160/273.1 |
| 7,299,848 | B2 * | 11/2007 | Streib | E06B 9/17007 160/243 |
| 7,699,088 | B2 * | 4/2010 | Coenraets | 160/113 |
| 7,798,198 | B2 * | 9/2010 | Rejc et al. | 160/133 |
| 8,113,265 | B2 * | 2/2012 | Hardison et al. | 160/273.1 |
| 8,627,605 | B2 * | 1/2014 | Drifka | E06B 9/17046 160/40 |
| 8,646,510 | B2 * | 2/2014 | Cloninger et al. | 160/310 |
| 8,789,576 | B2 * | 7/2014 | Krueger | A62C 2/10 160/133 |
| 9,249,621 | B2 * | 2/2016 | Dwarka | E06B 9/58 |
| 2003/0213180 | A1 * | 11/2003 | Ueda | E06B 9/17076 49/489.1 |

FOREIGN PATENT DOCUMENTS

| | | | |
|---|---|---|---|
| DE | 9314823 | U1 | 4/1994 |
| DE | 4343382 | A1 | 6/1994 |
| DE | 19741960 | A1 | 3/1999 |
| DE | 19906628 | A1 | 8/2000 |
| DE | 4343382 | C2 | 3/2003 |
| DE | 602005000182 | T2 | 8/2007 |
| DE | 202009015511 | U1 | 12/2010 |
| DE | 202010000712 | U1 | 12/2010 |
| EP | 0405519 | A2 | 1/1991 |
| JP | S34-014679 | A | 9/1959 |
| JP | 2003-328659 | A | 11/2003 |

OTHER PUBLICATIONS

Office Action mailed on Oct. 13, 2015, in connection with Japanese Patent Application No. 2015-510713, 4 pgs.

Decision to Grant issued on Jan. 19, 2016, in connection with Russian Partent Application No. 2014149124, 18 pgs. English translation is not available.

English translation (redacted) of Office Action mailed May 14, 2015, in connection with Chinese Patent Application No. 201380023529.9, 7 pgs.

Office Action mailed May 14, 2015, in connection with Chinese Patent Application No. 201380023529.9, 7 pgs. An English translation is not available at this time.

* cited by examiner

LIFTING DOOR ASSEMBLY AND DOOR LINTEL SEALING DEVICE THEREFOR

The present invention relates to a lifting door assembly, in particular a clean room door assembly, comprising a lifting door which has a door leaf, an end plate, and a door leaf accommodating device, and a door lintel sealing device which is provided in the area of a door lintel in such a way that it produces a sealing effect between the lifting door and the door lintel.

Such lifting door assemblies are typically used in industrial plants such as factory halls, storehouses or similar facilities. Moreover, due to the functionality that can meanwhile be achieved, they are also provided for clean room applications.

In the case of clean room applications such as, for instance, in the fields of pharmaceutics, medical engineering and biotechnology, aeronautics and astronautics, electronics, automotive industry and precision engineering, quick opening and closing for avoiding air losses, a smooth surface structure of the door leaf for the easy cleaning from particle depositions, and hence little maintenance effort are, for example, desired. Moreover, it is important to achieve high tightness of the lifting door assembly while keeping the construction and/or installation depth, i.e. the height of the door lintel, as small as possible.

With respect to tightness it is known to keep the clean room at excess pressure with respect to adjacent zones so as to avoid a possibly polluted air flow from the outside to the interior of the clean room. Despite the pressure difference between the clean room and the adjacent zone, however, leakages may occur in particular through a door lintel area of the lifting door assembly.

Prior art solutions of the tightness problem have repeatedly proposed a sealing assembly with a spring-biased deformation of a holding member and/or an elastic deformation of the sealing element itself. Thus, a permanent tight adherence of the sealing element to the door leaf is achieved.

DE 93 14 823 U1 discloses a roller shutter device for windows and doors. The sealing device illustrated here comprises supporting elements of spring steel at the entry gap to the door lintel area which support a sealing roller and press it against the roller shutter curtain.

U.S. Pat. No. 5,445,209 discloses a door assembly with a brush seal compensating for size alterations, etc. in a natural manner by the elasticity of the bristles. The guiding rollers at the entry slot in the door lintel area as illustrated there are, however, only available in the area of the lateral curtain edges.

DE 36 03 417 A1 discloses a sealing device for roller shutter casings and provides in some embodiments also a sealing element in the kind of brush seals or sealing profiles performing elastic deformations themselves for producing the sealing effect. In another embodiment, roller sealing elements are provided, wherein the sealing effect is, however, not produced by spring element supports, but is effected by gravity alone. These roller sealing elements rest against the door leaf.

Furthermore, document DE 60 2005 000 182 T2 discloses a roller door with a tight blanket. It comprises a sealing wing designed as a spring element and fastened in the door lintel area and/or a door leaf accommodation casing in such a way that it rests sealingly against the curtain in the area of the winding, supported by a prevailing excess pressure when the lifting door is closed.

Dragging seals have moreover also become known by the pendular strips on the roller shutter curtain pursuant to DE 43 43 382 A1.

DE 39 21 036 A1 finally discloses a sealing strip for lifting doors which rests permanently against the door leaf designed as a slatted curtain in this case. For this purpose, the sealing strip is mounted in a spring-biased manner around a notch and/or a spring-biased zone in such a way that it may evade toward the door lintel and/or spring back therefrom. This measure renders it possible that the sealing strip enables an adaptation to the respective distance of the door leaf from the door lintel in any position and in any direction of movement of the door leaf, so that distance variations between the frame casing and the door leaf are compensated for. Thus, the sealing strip rests reliably against the outer surface of the door leaf and a gap is avoided.

These sealing devices which are based on spring elasticity have in common that they produce their sealing effect by permanent contact with the door leaf since dragging and/or rolling seals are concerned here. The disadvantage, however, is that scratching and hence damage to the door leaf occurs.

A somewhat different configuration is disclosed by DE 199 06 628 A1 which quasi provides the provision of a one-sided movement gap between the curtain and the sealing device. This document discloses a lifting door assembly in the form of a smoke protection isolation by means of a lifting door which comprises a door curtain, an end plate and a door leaf accommodating device, and a door lintel sealing device which is provided in the area of a door lintel in such a way that it produces a certain—and, in the case of a fire, a complete—sealing effect between the lifting door and the door lintel.

This known door lintel sealing device consists of a fixed part, namely a resilient running edge via which the door leaf is deflected toward the winding, and of an inflatable seal which faces this running edge. In the normal case a one-sided movement gap results between the curtain and this inflatable seal. In the case of a fire this seal is supplied with compressed air so as to close this gap and to prevent the transfer of smoke, etc.

Since, however, the door leaf is deflected toward the winding via the fixed part of this known door lintel sealing device, scratching of the surface of the door leaf and hence damage thereto also occurs here which, apart from an impaired appearance, aggravates especially the cleaning of the door leaf in the long term. As has turned out in the scope of the instant invention, it would therefore be of advantage to provide a free movement gap between the components of the door lintel sealing device.

Moreover, in order to keep the door lintel height as small as possible and to additionally enable a smooth surface structure of the door leaf, the door leaf is designed as a flexible curtain with an end plate in many lifting door assemblies. The curtain may easily be cleaned from particles deposited thereon and takes only little place in the door lintel area when being wound up in the door lintel area. The end plate guarantees the necessary stabilization of the curtain with respect to forces acting from outside. For achieving maximum tightness, the gap from which the curtain exits from the door leaf and/or curtain accommodation casing is kept as narrow as possible with such systems, i.e. this movement gap is chosen to be just as wide that the curtain may pass without substantial friction losses.

This, however, means that the end plate which has typically larger dimensions and in particular a larger thickness than the curtain or the slatted curtain rests against a bottom edge of the door lintel and/or of the door lintel accommodation casing in a completely opened position of the lifting door, so that a maximally available height of the door opening is reduced by the height of the end plate resting against the door lintel.

This problem regarding the restricted utilization height of the door opening due to the end plate projecting therein has not been addressed in the state of the art. Only documents DE 199 09 628 A1 and U.S. Pat. No. 5,445,209 B disclose end plates. Most of the other prior art documents discussed above are roller shutter assemblies which are typically not provided with end plates.

The closest prior art DE 199 06 628 A1 does not offer a solution in this respect, either. The end plate is here indeed accommodated in an accommodation space in the area of the door lintel. This accommodation space, however, is actually positioned below the actual accommodating device for the winding of the door leaf, so that no reduction of the door lintel height and/or enlargement of the utilization height of the door opening results here.

It is therefore an object of the present invention to further develop a generic lifting door assembly in such a way that it enables a utilization of substantially the entire height of the door opening while maintaining the desired sealing effect.

This object is solved by a lifting door assembly as described herein. It is characterized in particular by the fact that at least one part of the door lintel sealing device is pivotably retained by means of a hinge and, when the lifting door is opened, can be pivoted from a door leaf plane by an actuating device in the area of the end plate in such a way that the end plate is arranged substantially completely outside the area of a door opening in the opened state of the lifting door.

The pivoting capability in accordance with the invention of at least one part of the door lintel sealing device about the hinge serving as a rotational joint thus enables for the first time that the end plate can be moved as far as into the door lintel area when the lifting door is opened. The door lintel sealing device thus does no longer constitute an obstacle in the movement area of the end plate.

It may thus emerge from the area of the door opening which has the advantage that the entire passage height of the door opening can be utilized.

Moreover, the risk of damage to the lifting door may be reduced since an object requiring the entire height of the door opening will no longer hit on the end plate then.

Advantageous further developments of the lifting door assembly according to the invention are also described herein.

Thus, the door leaf may be designed as a flexible curtain. Since such a curtain in the state wound on the door leaf accommodating device takes only little space as compared to a slatted door leaf, for instance, the object of reducing the door lintel height and hence of guaranteeing the maximally possible passage height of the door opening can be taken even better into account. Moreover, such a curtain is, due to the possibility of easy cleaning of its smooth surface structure and due to the clinical optics, particularly well-suited for clean room applications.

Furthermore, the end plate may have a larger thickness than the door leaf in at least one place, wherein at least one shoulder of the end plate serves as an actuating device. Thus, the pivoting mechanism of the door lintel sealing device can be triggered with little constructional effort.

In one embodiment variant the door lintel sealing device may comprise a pivotable part and a non-pivotable part, wherein the pivotable part is preferably provided on a door leaf inner side and the non-pivotable part is preferably provided on a door leaf outer side. This achieves a particularly simple, compact and reliable construction for the door lintel sealing device. In particular, only few parts have to be moved in the case of such a design.

In another embodiment variant the door lintel sealing device may comprise two pivotable parts which, when looked at from the side, face each other and accommodate the door leaf therebetween. Due to the substantially parallel arrangement of the sealing parts it is possible to hold the door leaf in a particularly stable manner and on a defined trajectory in the door leaf plane in the lifting door assembly. It is thus even better protected from forces acting on the door leaf from outside.

In another embodiment variant said at least one part of the door lintel sealing device may be formed of the hinge which is positioned in the area of the door lintel and of a circular tube profile which is fixed thereon and which rests against the end plate in the opened state of the lifting door. By such a design with a circular tube profile it is possible to achieve an advantageous sealing effect. Moreover, this embodiment variant has the advantage that, due to the small gap of the guides of the door leaf, the resulting friction noise during opening and closing of the lifting door can be reduced.

Moreover, two plastic caps each mounted axially on the sides of the circular tube profile may be arranged on the circular tube profile of the door lintel sealing device, so that the noise caused when the end plate hits on the door lintel sealing device may be reduced.

In a preferred embodiment the plastic caps are formed as rotatably mounted plastic rollers, so that the friction noise during opening and closing of the lifting door may be further reduced.

Furthermore, additional plastic parts may also be arranged on the end plate, said plastic parts hitting on the door lintel sealing device during opening of the lifting door. Also these plastic parts may counteract an increased noise production during opening and closing of the lifting door as well as counteract the wear of the latter.

In a particularly preferred embodiment the lifting door assembly is designed in such a way that the additional plastic parts are arranged on the end plate in such a way that they hit on the plastic caps and/or rollers of the door lintel sealing device when the lifting door is opened. Thus, the friction noise during opening and closing of the lifting doors can be reduced even further. Moreover, the wear during the actuation and/or taking along of the door lintel sealing device can be reduced again.

In accordance with two further aspects of the present invention, respective door lintel sealing devices for a lifting door assembly are provided. These door lintel sealing devices may serve as retrofitting parts for existing lifting door assemblies and constitute an independently tradable units in this respect.

Thus, the advantages explained above by means of the lifting door assembly according to the invention can be achieved.

Figure 1A:
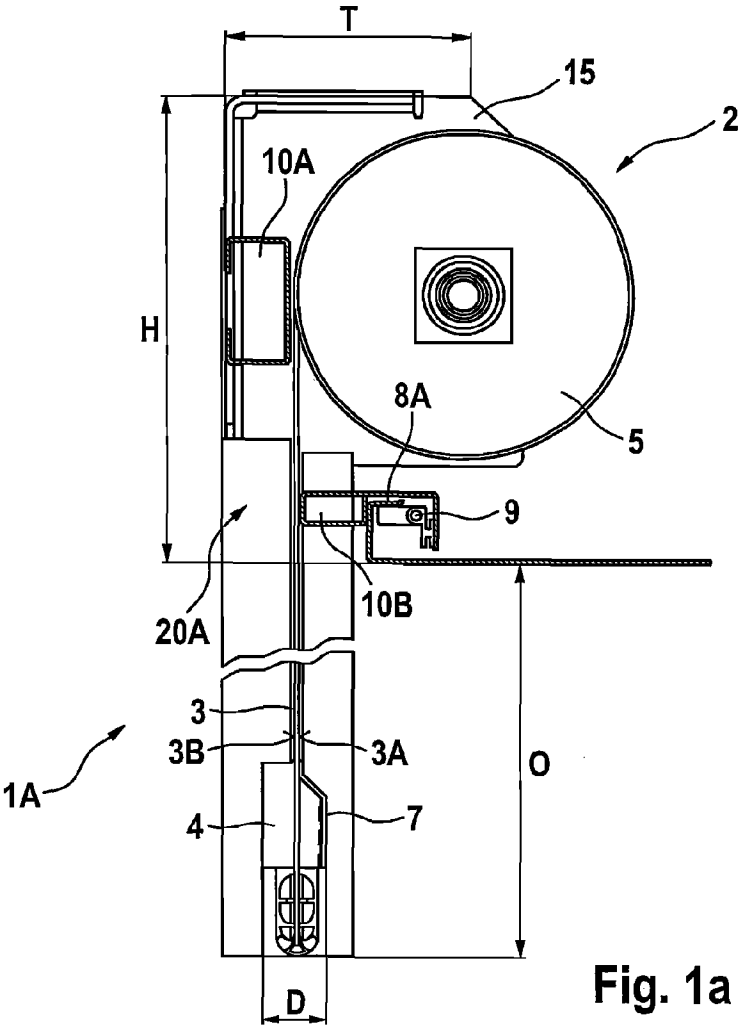
Figure 2B:
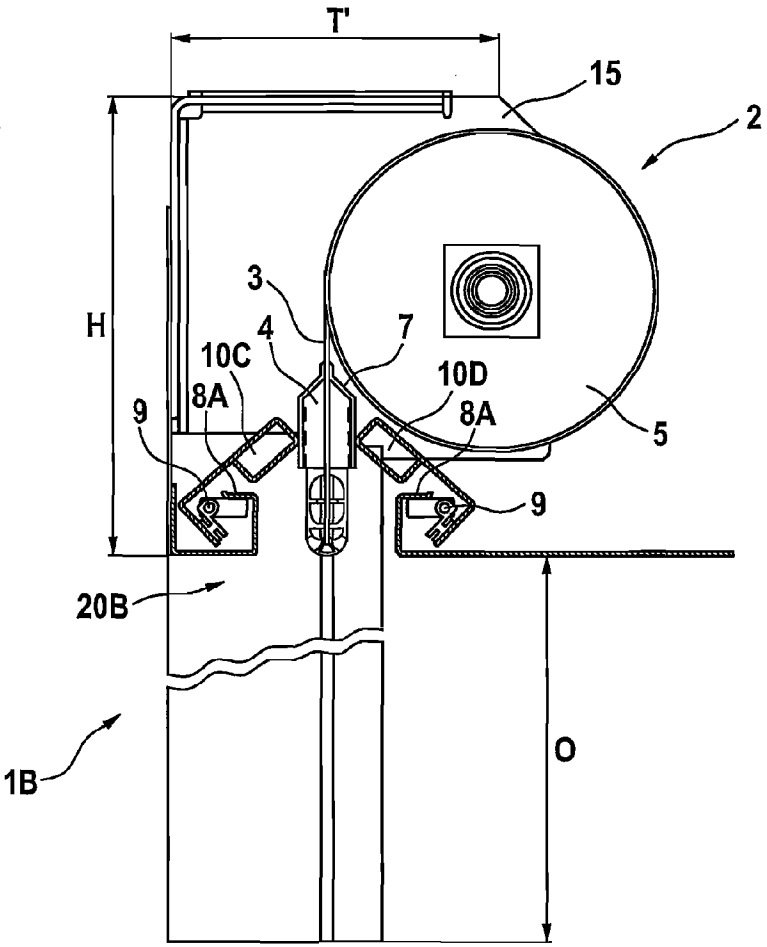
Figure 2A:
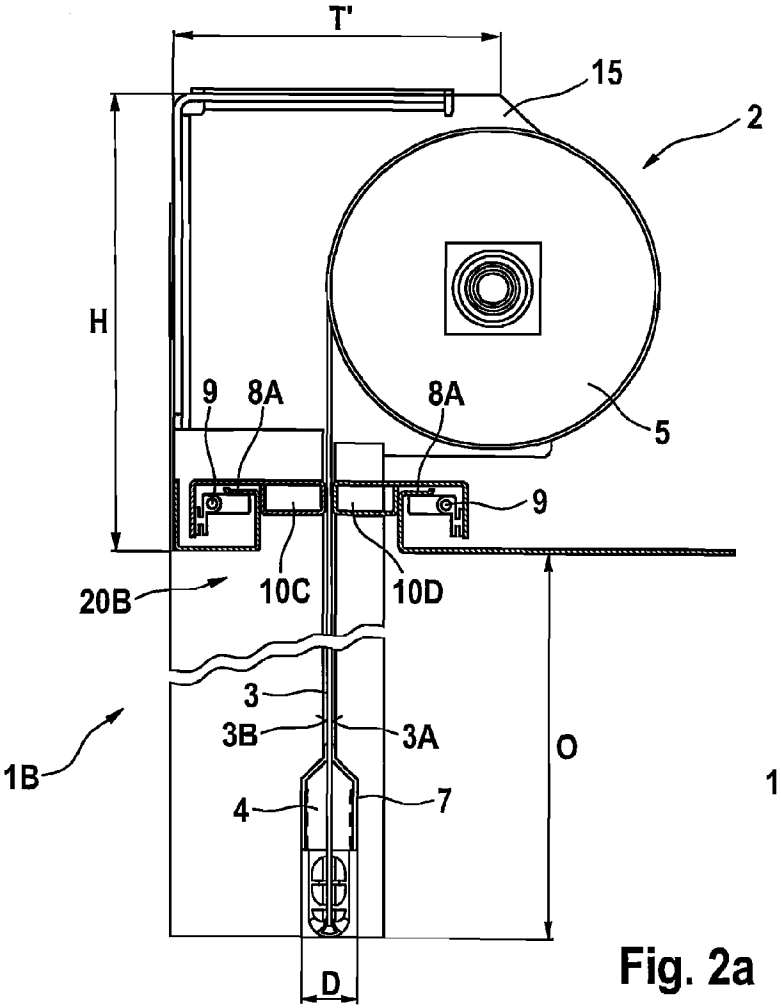
Figure 3B:
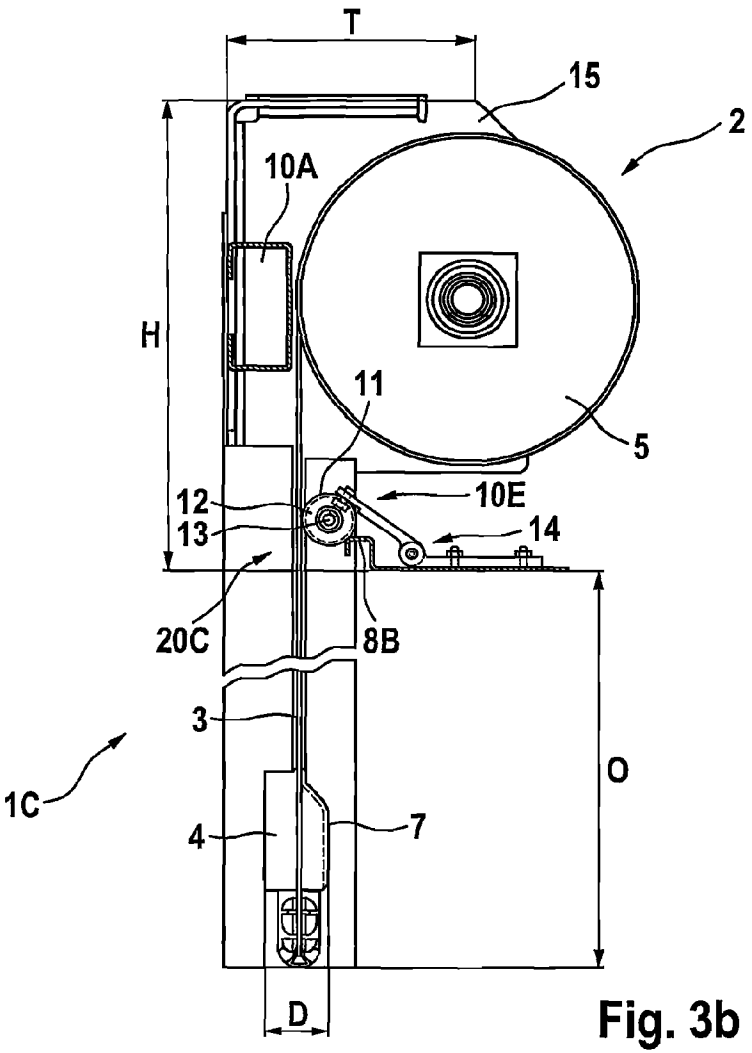
Figure 3A:
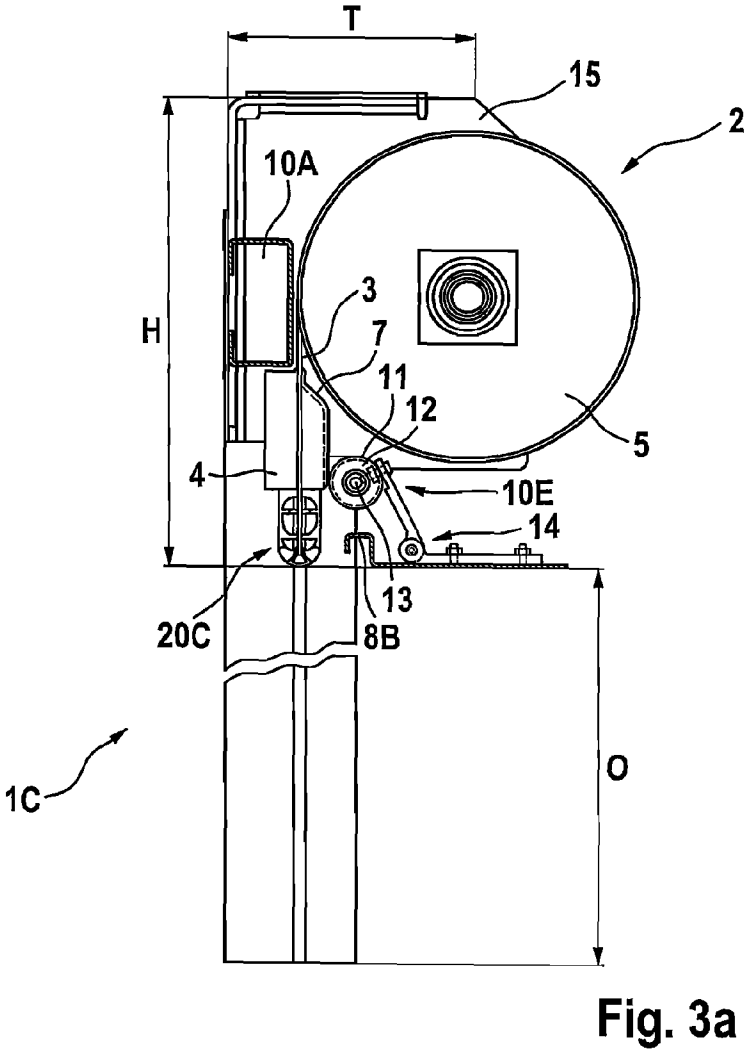
Figure 4B:
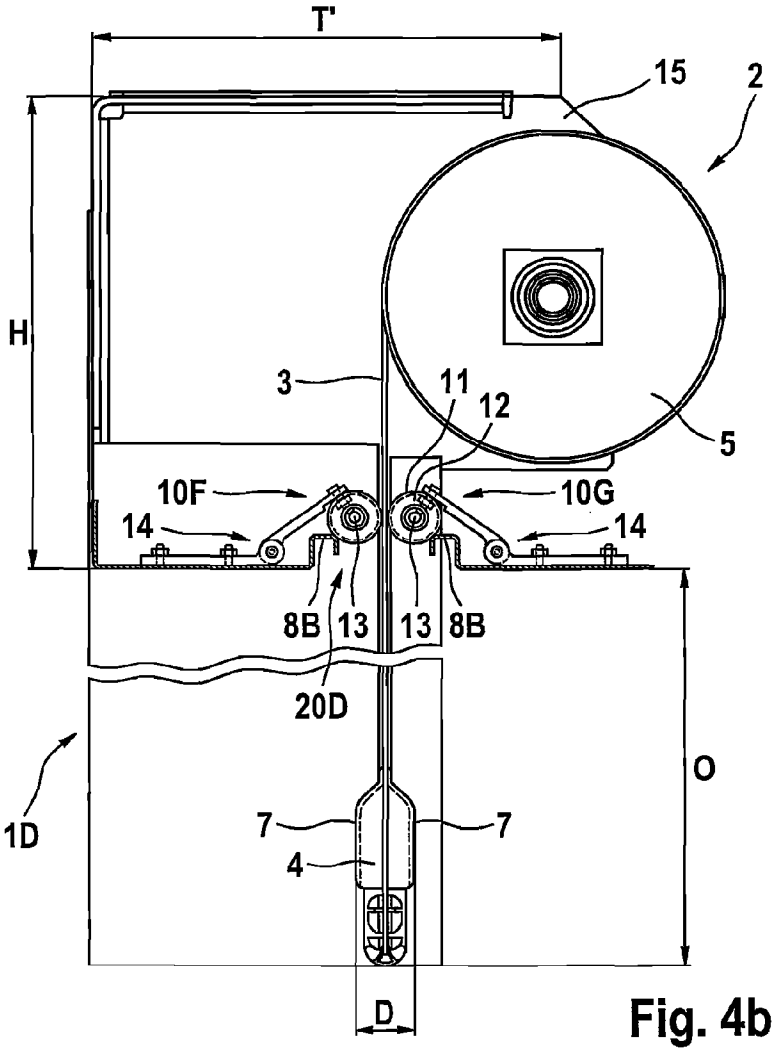
Figure 4A:
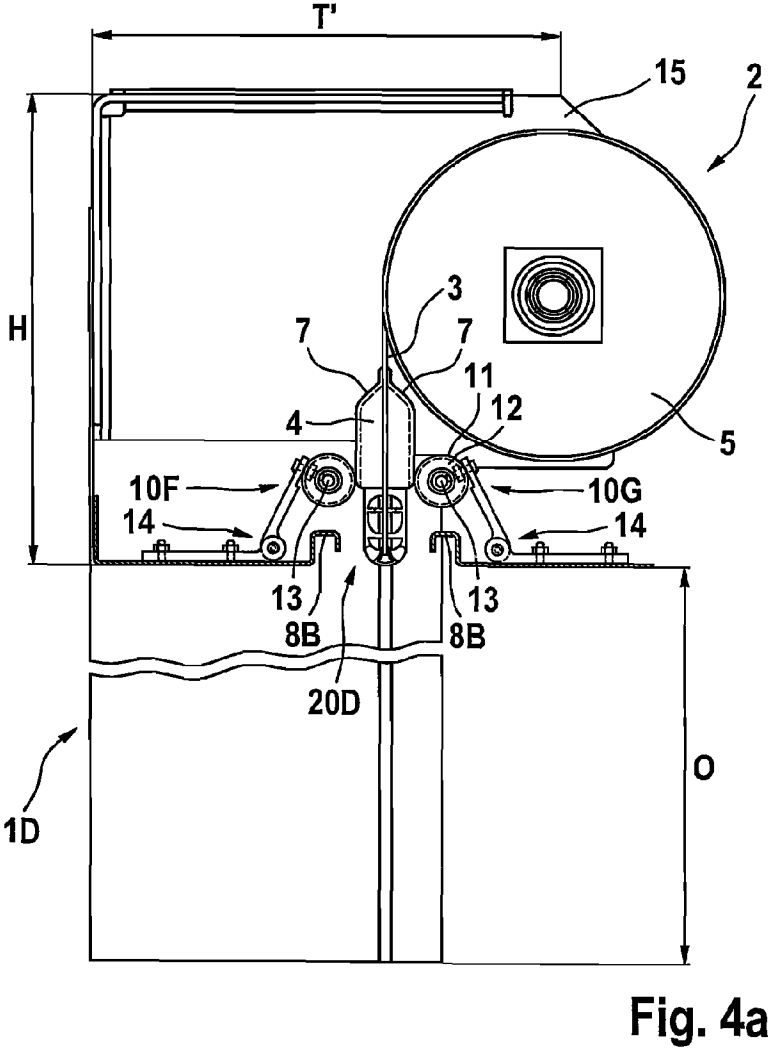
Figure 5B:
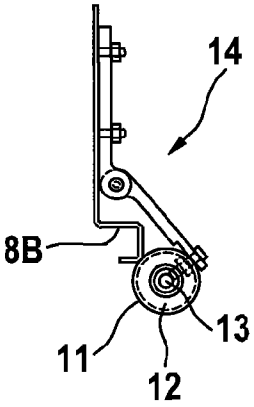
Figure 5A:
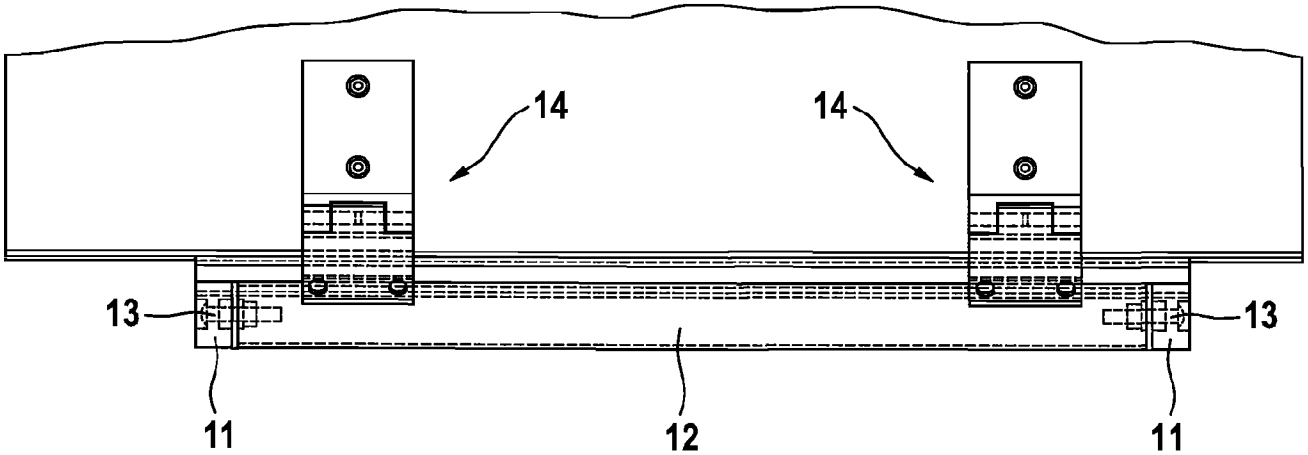

The invention will be explained in more detail in the following by means of the embodiments illustrated in the enclosed Figures. There show:

FIG. 1*a* a sectional view of a first embodiment of the lifting door assembly in accordance with the invention in the closed state;

FIG. 1*b* a sectional view of the lifting door assembly in accordance with the invention pursuant to FIG. 1*a* in the opened state;

FIG. 2*a* a sectional view of a second embodiment of the lifting door assembly in accordance with the invention in the closed state;

FIG. 2*b* a sectional view of the second embodiment of the lifting door assembly in accordance with the invention in the opened state;

FIG. 3*a* a sectional view of a third embodiment of the lifting door assembly in accordance with the invention in the opened state;

FIG. 3*b* a sectional view of the third embodiment of the lifting door assembly in accordance with the invention in the closed state;

FIG. 4*a* a sectional view of a fourth embodiment of the lifting door assembly in accordance with the invention in the opened state;

FIG. 4*b* a sectional view of the fourth embodiment of the lifting door assembly in accordance with the invention in the closed state;

FIG. 5*a* a plan view of the pivotable part of the door lintel sealing device according to the third or fourth embodiments of the lifting door assembly in accordance with the invention; and FIG. 5*b* a side view of the pivotable part of the door lintel sealing device according to the third or fourth embodiments of the lifting door assembly in accordance with the invention.

In accordance with the illustrations in FIGS. 1*a* and 1*b*, a lifting door assembly 1A comprises in a first embodiment a lifting door 2 with a door leaf 3, an end plate 4 and a door leaf accommodating device 5, as well as a door lintel sealing device 20A.

The door leaf 3 is designed in the kind of a flexible curtain. Such curtains are particularly preferred for clean room applications since they have a smooth and hence easy to clean surface structure. However, in order to provide the door leaf 3 or the curtain, respectively, with certain resistance to forces acting from the outside, it is provided with the end plate 4 which is here designed as a rigid body and which extends along the entire breadth of the curtain at the lower end thereof. In order to counteract too strong a noise development as well as wear during opening and closing of the lifting door 2 in the area of the end plate 4, additional plastic caps 7 are arranged on the sides of the end plate 4 which hit on the door lintel sealing device during opening and closing of the lifting door.

For the guiding of the door leaf 3 and of the end plate 4, guiding or sliding rails or the like (not illustrated) which are facing each other are arranged at both sides of a door opening O. The door leaf accommodating device 5 is designed as a winding shaft and extends horizontally in the area of a door lintel in the interior of a frame casing 15. It defines here a lintel depth T and a lintel height H. Such a design is sufficiently known in prior art.

As is further revealed by FIGS. 1*a* and 1*b*, the end plate 4 has a larger thickness D than the door leaf 3. This is especially due to the fact that the end plate 4, for achieving adequately high stability, has appropriately large dimensions so as to guarantee the desired tightening of the door leaf 3.

Moreover, FIGS. 1*a* and 1*b* illustrate the door lintel sealing device 20A. It is fixed in the area of the door lintel to the inner walls at the frame casing 15. The door lintel sealing device 20A consists substantially of two parts, a pivotable part 10B and a non-pivotable part 10A. The pivotable part 10B is provided on a door leaf inner side 3A and the non-pivotable part 10A is provided on a door leaf outer side 3B. The door leaf inner side 3A defines the side facing the clean room and the door leaf outer side defines the side facing an adjacent zone. The pivotable part 10B and the non-pivotable part 10A form a small movement gap therebetween in which the door leaf is adapted to move freely, i.e. without friction impact.

The pivotable part 10B is hinged about a hidden hinge 9 and rests in its rest position on an inner portion 8A of the frame casing 15 in such a way that it can be pivoted upward, i.e. in the direction away from the door opening, against the direction of the gravitational effect only. The hidden configuration of the hinge 9 enables protection from pollutions which might, for instance, fall down from the wound-up curtain. Moreover, a relatively long swiveling lever results therefrom, which facilitates the actuation of the pivotable part 10B and thus maintains functionality for a long term. When looking at the door lintel sealing device 20A from the side, the non-pivotable part is arranged to be positioned higher than the pivotable part 10B.

If, in the afore-illustrated lifting door assembly 1A, a system for placing the clean room under excess pressure (not illustrated) is activated, the result thereof is that the door leaf 3 is displaced laterally within the free movement gap and is pressed in this process against the sliding rails (not illustrated) and in the area of the door lintel against the non-pivotable part 10A of the door lintel sealing device 20A and thus seals the clean room from the adjacent zone. The closed state of the lifting door assembly is illustrated in FIG. 1*a*. The area of the door lintel is defined by the frame casing 15.

FIG. 1*b*, however, illustrates an actuation state of the lifting door assembly 1A in which the lifting door 2 is in a completely open position. As may be gathered, a shoulder of the end plate 4 which serves as an actuating device acts in the course of the upward movement of the lifting door 2 on the pivotable part 10B of the door lintel sealing device 20A in such a way that it is pivoted away from the door leaf plane and hence in the direction of the door lintel, i.e. against the direction of the gravitational force. In the opened state of the lifting door 2 the pivotable part 10B of the door lintel sealing device 20A rests against the side wall of the end plate 4. Thus, the end plate 4 and hence substantially the entire lifting door can be moved as far as into the frame casing 15 which defines the lintel height H. As may further be gathered from FIG. 1*b*, a sealing effect preventing the infiltration of dirt particles, etc. in the frame casing 15 exists in the area of the door lintel even in the opened state of the lifting door 2.

It has to be noted in this respect that the pivotable part 10B of the door lintel sealing device 20A, due to the free movement gap existing for this purpose, is not moved and/or pivoted by the door leaf 3, but only by the action on the contour of the end plate 4. Thus, scratching and/or wear of the curtain face is reliably prevented. On closing of the door leaf 3, the pivotable part 10B of the door lintel sealing device 20A pivots back automatically to its rest position due to gravitation and forms again the predetermined movement gap for the door leaf 3.

FIGS. 2*a* and 2*b* illustrate a lifting door assembly 1B as a second embodiment. For avoiding redundant parts of the description, only the features differing from the first embodiment will be explained in more detail in the following.

These can be found in particular in that here two pivotable parts 10C, 10D of a door lintel sealing device 20B are provided which are facing each other and form a free movement gap for the door leaf, and which are suited to accommodate the door leaf 3 therebetween. The two pivotable parts 10C, 10D have the same design as the afore-described pivotable part 10B and are facing each other in a mirror-like manner, as is illustrated in FIGS. 2*a* and 2*b*.

As compared to the embodiment illustrated in FIGS. 1*a* and 1*b*, the lifting door assembly 1B according to FIGS. 2*a* and 2*b* has indeed a larger lintel depth T'. However, the door leaf 3 is positioned in a more advantageous manner between the two pivotable parts 10C, 10D since they are arranged at equal height here and thus accommodate the door leaf 3 therebetween in a safer and better guided manner. For accommodating the end plate 4 in the frame casing 15, the two pivotable parts 10C, 10D each perform a pivoting movement about the associated hinge 9 in a direction contrary to the gravitational force and away from the door opening.

FIGS. 3*a* and 3*b* illustrate a lifting door assembly 1C in accordance with a third embodiment in which a pivotable part 10E of the door lintel sealing device 20C is formed substantially of a hinge 14 which is positioned in the area of the door lintel, and of a circular tube profile 12 which is fastened thereon and rests against the door leaf 3 in the closed state of the lifting door 2. More precisely, the hinge 14 is fixed with one side at an inner side of the frame casing 15, wherein the other side of the hinge 14 is pivotable with a circular tube profile 12 which is fixed there at the end side and rests against or on the end plate 4 or an inner section 8B of the frame casing 15 due to gravitational force.

In addition to the tube profile 12 which is, for instance, designed as a rotatable circular tube, there are provided two plastic caps 11 which are designed as plastic rollers and which are each rotatably mounted axially at the sides of the tube profile 12 by means of a bearing shaft 13. These plastic caps 11 are dimensioned such that they are available at least in the breadth of the plastic caps 7 of the end plate 4 and hit thereon during opening and closing of the lifting door 2.

For accommodation of the end plate 4, the tube profile 12 pivots about the hinge 14 in the direction contrary to the gravitational force and away from the door opening.

The lifting door assembly 1D illustrated in FIGS. 4*a* and 4*b* differs from the lifting door assembly 1C illustrated in FIGS. 3*a* and 3*b* in a way comparable to the way the lifting door assembly 1B illustrated in FIGS. 2*a* and 2*b* differs from the lifting door assembly 1A illustrated in FIGS. 1*a* and 1*b*, namely in that two pivotable parts 10F, 10G of a door lintel sealing device 20D are provided which are facing each other and form a free movement gap for the door leaf, and which are suited to accommodate the door leaf 3 therebetween. The two pivotable parts 10F, 10G have the same design as the afore-described pivotable part 10E and are facing each other in a mirror-like manner, as is illustrated in FIGS. 4*a* and 4*b*.

For accommodation of the end plate 4 in the frame casing 15, the two pivotable parts 10F, 10G each perform a pivoting movement about the associated hinge 14 in a direction contrary to the gravitational force and away from the door opening.

In addition to the embodiments explained, the invention allows for further design approaches.

Alternatively to the flexible curtain explained, the door leaf 3 may, for instance, also be designed as a slatted curtain, as a sectional door leaf, or the like. In this case, instead of the winding shaft, a spiral guide may, for instance, also be used as a door leaf accommodating device which enables a touchfree winding of the door leaf.

In a further alternative embodiment in which the door leaf 3 is not formed by a flexible curtain, but, for instance, by slatted portions having larger and/or thicker dimensions, the thickness D of an end plate may also be equal to or smaller than the thickness of the door leaf 3. Thus, the pivoting of the pivotable part 10B, etc. need not necessarily be initiated by the end plate 4. Alternatively, instead of the direct action on the end plate 4, this may also be performed by means of an actuating device provided in addition to the end plate 4, preferably in the vicinity thereof. The pivotable part 10B, etc. of the door lintel sealing device 20A and/or 20B may thus, for instance, also be pivoted by means of alternative actuating devices such as other engagement elements, electrically controlled devices or magnetic mechanisms, passively by taking along or actively by a suitable control.

The shape of the end plate 4 is not restricted to the shape illustrated in the Figures. The cross-section of the end plate 4 which is typically an extruded profile may, as required, be replaceable e.g. by a circular, elliptical, semicircular, rectangular, triangular, symmetrical or asymmetrical profile. Moreover, the end plate 4 may also incorporate a safety strip (not illustrated) for door safety.

The pivotable parts 10B, 10C and 10D which are illustrated in the Figures as identical and/or symmetrical components may, as required by the application, also have shapes deviating from each other and, depending on the kind of engagement and/or the function of interaction between themselves and the end plate 4 and/or the actuation device, have appropriate designs.

The plastic caps 11 illustrated in FIGS. 3*a* to 5*b* are not restricted to the afore-described embodiments. Alternative embodiments such as polygonal, oval, etc. caps of different (plastic) material compositions are conceivable. The same applies to the circular tube profile 12 which may alternatively be designed as a polygonal, oval, etc. profile.

It is to be understood that the lifting door assembly described above in particular for the use in clean rooms is not restricted to this application, but may also serve as a room divider for any other facilities, buildings, etc. In this respect, the use in the field of fire protection is especially also possible in order to efficiently prevent the passage of smoke, fire gases, etc.

Furthermore, the door lintel sealing devices 20A, 20B, 20C and/or 20D may also be retrofitted on existing lifting doors 2 so as to make, besides the achieving of a desired sealing effect, the available height of the door opening O completely usable.

The invention claimed is:

1. A lifting door assembly, comprising:

a lifting door which has a door leaf, an end plate, and a door leaf accommodating device, the end plate having a larger thickness than the door leaf in at least one place, and a door lintel sealing device which is provided in such a way that it produces a sealing effect between the lifting door and a door lintel, wherein:

at least one part of the door lintel sealing device is pivotably retained by means of a hinge and, when the lifting door is in an opened state, at least one shoulder of the end plate directly contacts the at least one part of the door lintel sealing device to pivot the at least one part away from a door leaf plane in such a way that the end plate is arranged substantially completely outside of a door opening in the opened state of the lifting door.

2. The lifting door assembly according to claim 1, wherein the door leaf is a flexible curtain.

3. The lifting door assembly according to claim 1, wherein the door lintel sealing device comprises a pivotable part and a non-pivotable part, wherein the pivotable part is provided on a door leaf inner side and the non-pivotable part is provided on a door leaf outer side.

4. The lifting door assembly according to claim 1, wherein the door lintel sealing device comprises two pivotable parts each configured to pivot in a substantially mirrored movement with respect to the door leaf plane and accommodating the door leaf therebetween.

5. The lifting door assembly according to claim 1, wherein said at least one part of the door lintel sealing device is formed of the hinge, and of a circular tube profile which is fixed on the hinge and which rests against the end plate in the opened state of the lifting door.

6. The lifting door assembly according to claim 5, wherein said at least one part of the door lintel sealing device further comprises two plastic caps each mounted axially on sides of the circular tube profile.

7. The lifting door assembly according to claim 6, wherein the plastic caps are rotatably mounted plastic rollers.

8. The lifting door assembly according to claim 1, wherein additional plastic parts are arranged at the end plate, said additional plastic parts contacting the door lintel sealing device when the lifting door is opened.

9. The lifting door assembly according to claim 6, wherein additional plastic parts are arranged at the end plate in such a way that they contact the plastic caps of the door lintel sealing device when the lifting door is opened.

10. A door lintel sealing device for a lifting door assembly, the lifting door assembly comprising a lifting door which has a door leaf, an end plate, and a door leaf accommodating device, the end plate having a larger thickness than the door leaf in at least one place, the door lintel sealing device provided in such a way that it produces a sealing effect between the lifting door and the door lintel, the door lintel sealing device comprising:

a pivotable part pivotably retained by means of a hinge and, when the lifting door is in an opened state, at least one shoulder of the end plate directly contacts the pivotable part to pivot the pivotable part away from a door leaf plane in such a way that the end plate is arranged substantially completely outside of a door opening in the opened state of the lifting door; and a non-pivotable part.

11. A door lintel sealing device for a lifting door assembly, the lifting door assembly comprising a lifting door which has a door leaf, an end plate, and a door leaf accommodating device, the end plate having a larger thickness than the door leaf in at least one place, the door lintel sealing device provided in such a way that it produces a sealing effect between the lifting door and the door lintel, the door lintel sealing device comprising:

two pivotable parts each configured to rotate in a substantially mirrored movement with respect to a door leaf plane and to accommodate the door leaf therebetween, wherein at least one pivotable part of the two pivotable parts is pivotably retained by means of a hinge and, when the lifting door is in an opened state, at least one shoulder of the end plate directly contacts the at least one pivotable part to pivot the at least one pivotable part away from the door leaf plane in such a way that the end plate is arranged substantially completely outside of a door opening in the opened state of the lifting door.

12. The lifting door assembly according to claim 2, wherein the door lintel sealing device comprises a pivotable part and a non-pivotable part, wherein the pivotable part is provided on a door leaf inner side and the non-pivotable part is provided on a door leaf outer side.

13. The lifting door assembly according to claim 1, wherein the door lintel sealing device comprises a pivotable part and a non-pivotable part, wherein the pivotable part is provided on a door leaf inner side and the non-pivotable part is provided on a door leaf outer side.

14. The lifting door assembly according to claim 2, wherein the door lintel sealing device comprises two pivotable parts each configured to pivot in a substantially mirrored movement with respect to the door leaf plane and accommodating the door leaf therebetween.

15. The lifting door assembly according to claim 1, wherein the door lintel sealing device comprises two pivotable parts each configured to pivot in a substantially mirrored movement with respect to the door leaf plane and accommodating the door leaf therebetween.

16. The lifting door assembly according to claim 2, wherein said at least one part of the door lintel sealing device is formed of the hinge, and of a circular tube profile which is fixed on the hinge and which rests against the end plate in the opened state of the lifting door.

17. The lifting door assembly according to claim 1, wherein said at least one part of the door lintel sealing device is formed of the hinge, and of a circular tube profile which is fixed on the hinge and which rests against the end plate in the opened state of the lifting door.

18. The lifting door assembly according to claim 3, wherein said at least one part of the door lintel sealing device is formed of the hinge, and of a circular tube profile which is fixed on the hinge and which rests against the end plate in the opened state of the lifting door.

* * * * *